US005181383A

United States Patent [19]

Goto et al.

[11] Patent Number: 5,181,383

[45] Date of Patent: Jan. 26, 1993

[54] REFRIGERATOR

[75] Inventors: Eiichi Goto, Fujisawa; Qiquan Geng, Chigasaki; Junpei Yuyama, 2-28-2, Morinosato, Atsugi-shi, Kanagawa-ken, all of Japan

[73] Assignees: Research Development Corporation of Japan, Tokyo; Junpei Yuyama, Atsugi, both of Japan; a part interest

[21] Appl. No.: 723,384

[22] Filed: Jun. 28, 1991

[30] Foreign Application Priority Data

Jun. 28, 1990 [JP] Japan ..... 2-170787

[51] Int. Cl.[5] ..... F25B 9/00

[52] U.S. Cl. ..... 62/6; 62/86; 62/401

[58] Field of Search ..... 62/6, 86, 401, 402

[56] References Cited

U.S. PATENT DOCUMENTS

| | | | |
|---|---|---|---|
| 3,237,421 | 6/1966 | Gifford | 62/6 |
| 3,438,220 | 4/1969 | Collins | 62/6 |
| 3,690,113 | 9/1972 | Mokadam | 62/6 |
| 4,123,916 | 11/1978 | Kreger | 62/6 |
| 4,354,355 | 10/1982 | Lawless | 62/6 |

OTHER PUBLICATIONS

"Low-Temperature Expansion Pulse Tube"; Adv. Cryog. Eng., vol. 29, 1985; pp. 629–639; E. I. Mikulin et al.

"Pulse Tube Refrigeration-A New Type of Cryocooler"; Jpn. J. Appl. Phys., Suppl. 26-3, vol. 26, 1987, pp. 2076–2081; Ray Radebaugh.

"A Single Stage Double Inlet Pulse Tube Refrigerator Capable of Reaching 42K"; Cryogenics, vol. 30, Suppl., pp. 257–261; Shaowei Zhu et al.

*Primary Examiner*—Ronald C. Capossela

*Attorney, Agent, or Firm*—Oblon, Spivak, McClelland, Maie & Neustadt

[57] ABSTRACT

In a refrigerator having a compressor settled in a room temperature portion and an expander which is connected to the room temperature portion, a piston of the expander is settled in the room temperature portion and pressure variation at a low temperature portion is transferred to the piston through a gas column in a pipe connecting the room temperature portion and the low temperature portion.

4 Claims, 7 Drawing Sheets

REFRIGERATOR

FIELD OF THE INVENTION

This invention relates to a refrigerator for cooling a cryopump which is widly used in the field of semiconductor manufacturing, for cooling thermal shield of a magnetic resonance imaging diagnostic system, for reliquifying helium vapor in a cooling vessel, for cooling an element to be operated at a very low temperature such as a Josephson device like a superconducting quantum interference device(SQUID) or an infrared sensor, and for cooling a computer which uses superconducting devices.

BACKGROUND OF THE INVENTION

The first problem to be solved in this invention is to improve the reliability and minimize the size of the refrigerator by removing a piston or a displacer which is a moving part in a low temperature portion. In the two stage type Gifford-MacMahon (G-M) refrigerator or the Stirling refrigerator, a sliding seal is used at a low temperature. At low temperatures, elastic materials such as rubber are hardened and can not be used. In order to closely contact an outer periphery of the seal with an inner surface of a cylinder, high precision processing are needed and cost very much. Further, since at low temperatures lubrication oil or grease can not be used, the seal has to be replaced frequently due to wear. Therefore, in a refrigerator having an expander (such as a Claude cycle machine), the seal is not provided in a low temperature portion, but the seal is provided in room temperature portion by using a long piston. However, in this case, in order to decrease heat inflow due to heat conduction through the piston and another heat inflow (shattle loss) due to a difference between temperature distributions in the piston and the cylinder during oscillating mortion of the piston, the length of the piston should be increased. This prohibits minimizing the refrigerator.

As an attempt to remove the displacer or the piston in the low temperature portion, a pulse tube refrigerator has been proposed. This refrigerator dose not have moving parts in a low temperature portion, but there is a problem to be solved such that degradation of performance of a regenerator at low temperatures should be improved to decrease an attained temperature. This is the second problem that this invention intends to solve. The degradation of parformance is caused because heat capacity of the regenerator becomes smaller than that of helium gas. Recently, it has been reported that the G-M refrigerator or the Starling refrigerator reached to temperatures below 4 K by using magnetic materials having large specific heat capacities at low temperatures as regenerator matrixes. However, the degradation of performance of the regenerator at low temperatures can not be solved in the pulse tube refrigerator.

SUMMARY OF THE INVENTION

This invention characterized in that in the refrigerator having a compressor settled in a room temperature portion and an expander which is connected to the room temperature portion, a piston of the expander is settled in the room temperature portion and pressure oscillation at a low temperature portion is transmitted to the piston through a gas column in a pipe connecting the room temperature portion and the low temperature portion.

DETAILED DESCRIPTION OF THE PREFERRED EMBODIMENTS

Figure 1:
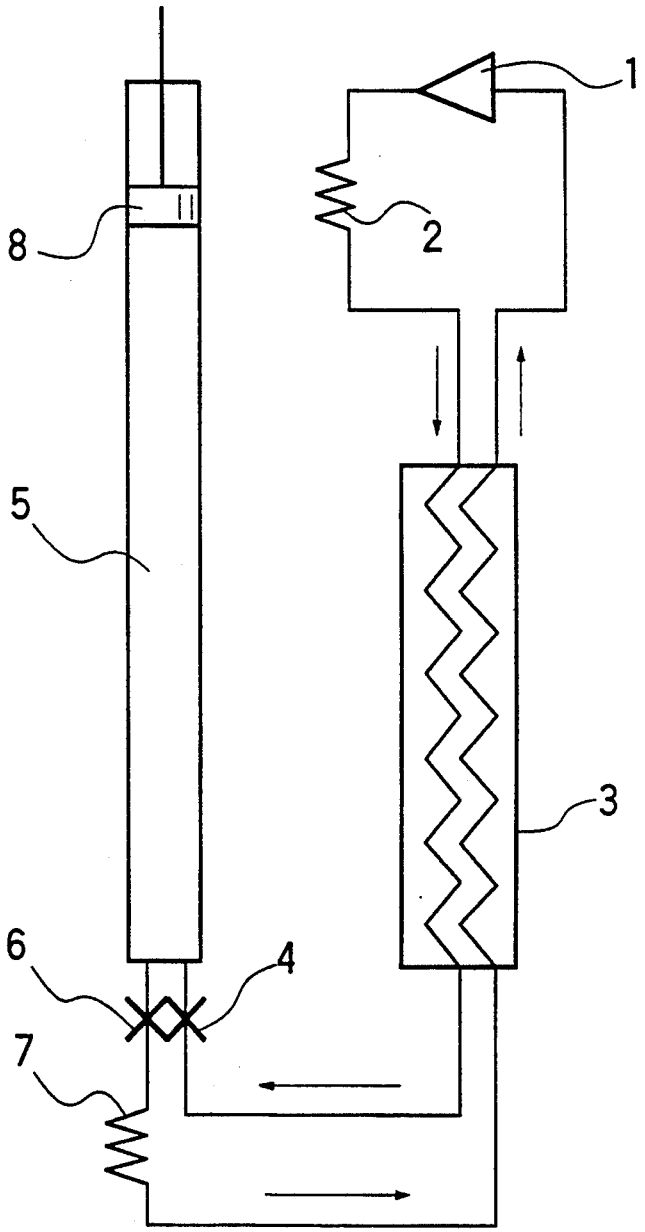
FIG. 1 is a schematic diagram showing a basic construction of this invention.

Referring now to FIG. 1, the present invention, which solves the above discussed problems, will be explained.

Working fluid (helium gas) compressed by a compressor 1 is cooled in a cooler 2 and further cooled by heat-exchanging with low temperature gas in a heat-exchanger 3 and then flows through an intake valve 4 into a pressure transmitting pipe 5. In the pressure transmitting pipe 5, the gas is expanded to decrease its temperature and passes through an exhaust valve 6 and takes heat from the circumference in a heat absorber 7. In the heat-exchanger 3, the gas from the heat absorber cools the hot gas from the cooler 2 and then the gas from the heat absorber itself is warmed and returned to the compressor 1. The compressor 1 and the cooler 2 are settled at room temperature. On the other hand, the intake valve 4, the exhaust valve 6 and the heat absorber 7 are settled at a low temperature. The circulating cycle of the working fluid(helium gas) described above is almost the same as that in the conventional refrigerator having an expander.

The feature of this invention resides in that the expander having a piston is not provided in a low temperature portion and the working fluid expands in the pressure transmitting pipe 5 connected to a room temperature portion. The work done by the expansion is transferred in the pressure transmitting pipe 5 from the low temperature portion to the room temperature portion and taken out to the outside by the piston 8 located in the room temperature portion. The heat exchange between the working fluid and the pipe wall in the pressure transmitting pipe 5 causes net heat flow from the room temperature end to the low temperature end, therefore, it is desired to keep the gas in the pipe adiabatic, for example, by decreasing the heat capacity of the pipe wall of the pressure transmitting pipe 5 so as to make smaller the amount of the heat transferred.

Figure 2:
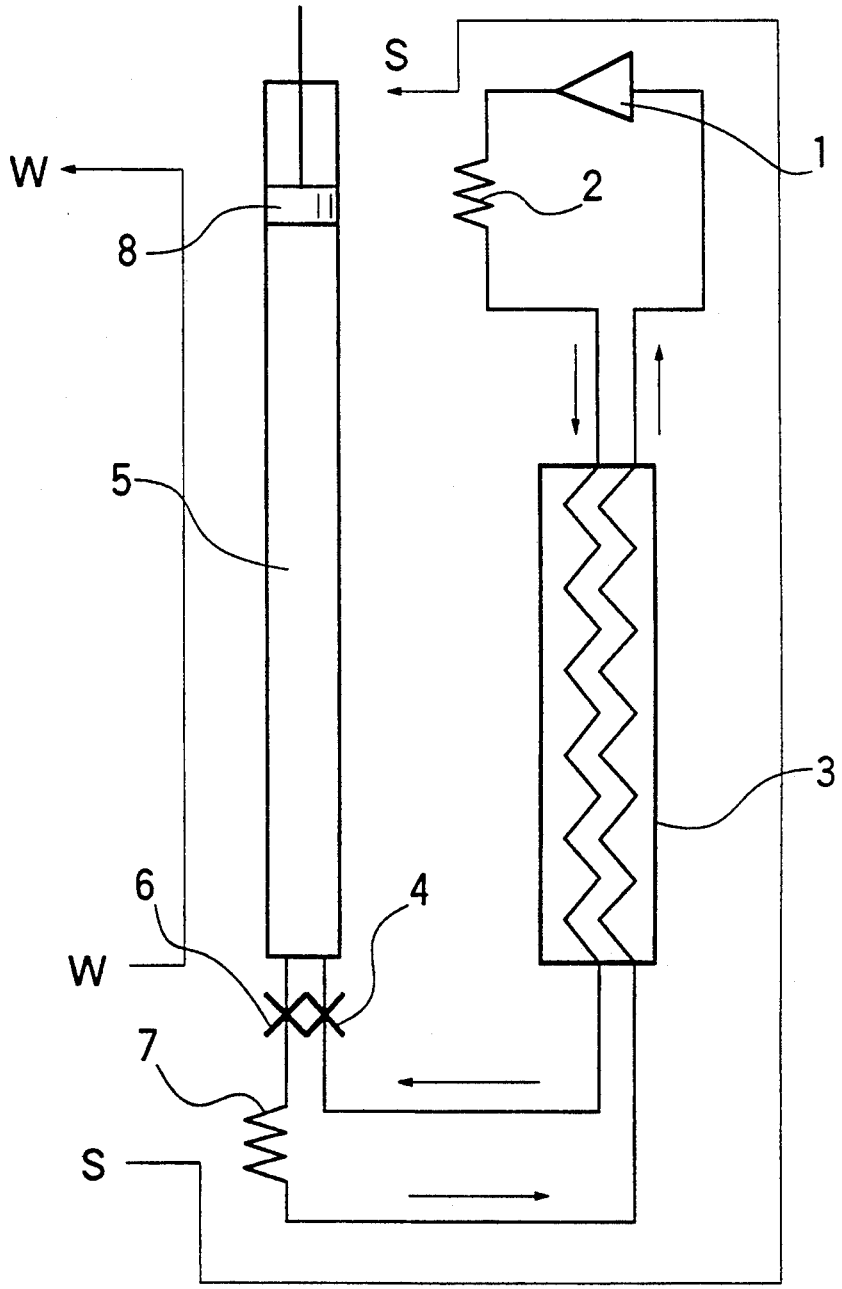
FIG. 2 is a schematic diagram showing flows of work and entropy in the refrigerator according to this invention.
Figure 3A:
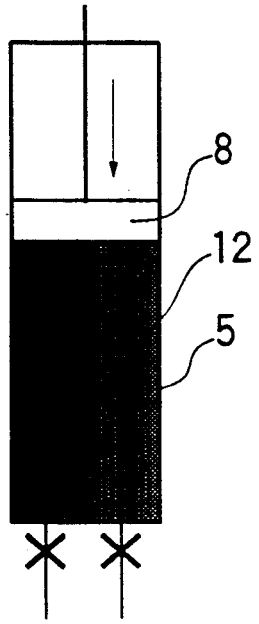
FIG. 3 illustrates a working cycle of the refrigerator according to this invention.
Figure 3B:
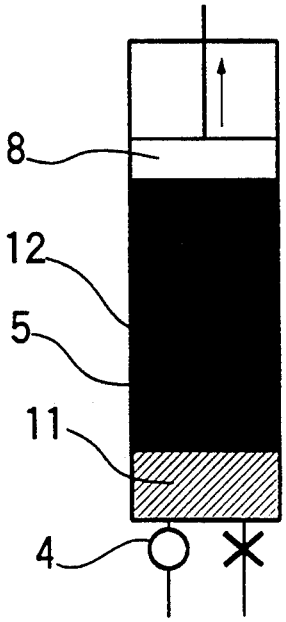
Figure 3C:
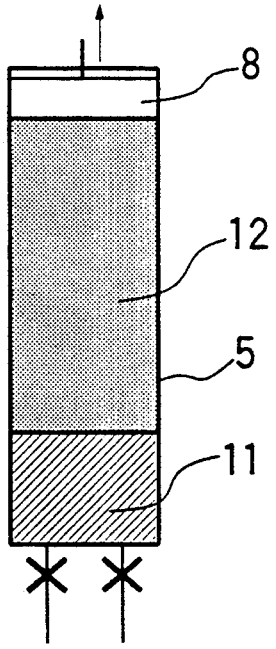
Figure 3D:
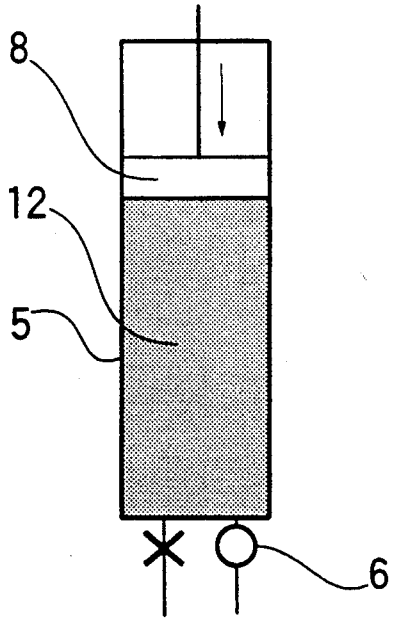

FIG. 2 shows flows of the work and the entropy in the process described above. The work W due to expansion of the working fluid is transferred through a gas column to the piston 8 in the room temperature and taken out to the outside. On the other hand, the entropy S flown into the working fluid from the outside in the heat absorber passes through the heat exchanger 3 and taken out to the outside by the compressor 1 and the cooler 2. If in the compressor 1 isothermal compression is carried out. all of the entropy S is removed in this compressor 1 and the cooler 2 becomes dispensable. If adiabatic compression is carried out, all of the entropy S is removed in the cooler 2. In reality, the compression is carried out by an intermediate process between those processes, so that the entropy is removed in both of the compressor 1 and the cooler 2.

FIG. 3 shows rising and descending timings of piston 8 and opening and closing timings of the intake valve 4 and the exhaust valve 6 in the refrigerator according to this invention. One cycle is completed in the following order: (a) compression (the piston is descending and both of the valves are closed), (b) intake (the piston is rising, the intake valve is open, and the exhaust valve is closed), (c) expansion (the piston is further rising and both of the valves are closed), and (d) exhaust (the piston is desending, the intake valve is closed and the exhaust valve is open). In FIG. 3, the working fluid coming in and going out through the valves is designated by the reference numeral 11 and the gas column constantly present in the pressure transmitting pipe 5 for transmitting pressure between the working fluid 11 and the piston 8 is designated by the reference numeral 12.

Figure 4:
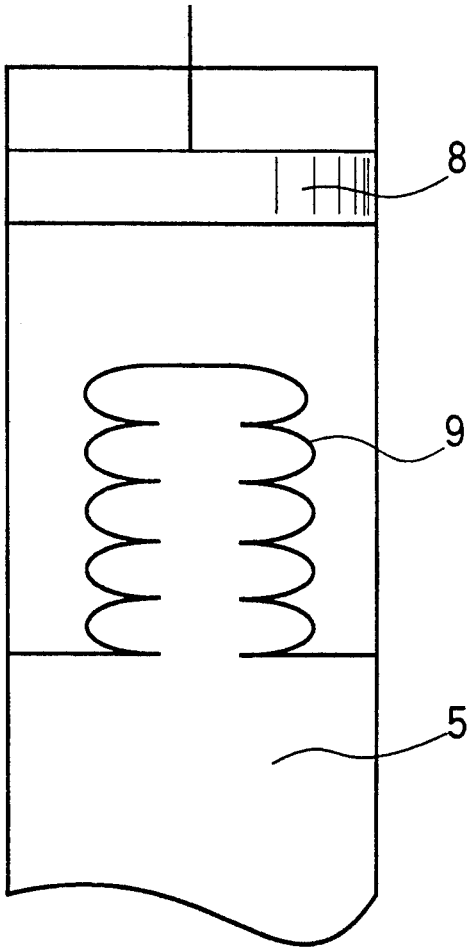
FIG. 4 shows a schematic diagram showing separation of working fluid and a piston by means of a bellow.

The basic construction and its operation have been described in the above. Various modifications can be made in this invention. As shown in FIG. 4, it is preferable to separate the piston 8 from the gas of the pressure transmitting pipe 5 by a thin bellows 9 made of high polymers or rubber. In this construction, since the gas on the piston 8 side is separated from the gas on the pressure transmitting pipe 5 side which is connected to the low temperature portion, lubrication oil or grease can be used for the piston 8 and flakes worn off from the seal are not introduced into the low temperature portion. Such a partition can not be provided if the piston is provided in the low temperature portion. This is one of the advantages of this invention.

Figure 5:
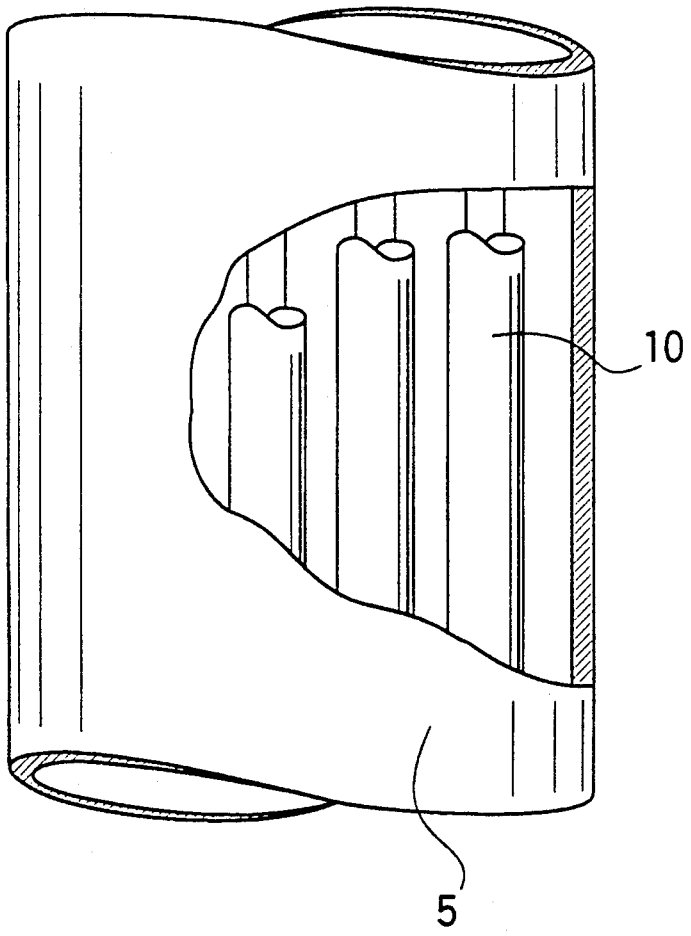
FIG. 5 is a schematic diagram showing insertion of thin pipes into a pressure transmitting pipe.

Further, it is preferable to insert thin pipes 10 into the pressure transmitting pipes 5 as shown in FIG. 5. These pipes reduce the Reynolds number in the pressure transmitting pipe 5 to prevent generation of turbulent flow. In this case, it is needed to select the diameter and the thickness of the pipes so that the heat capacity of the pipes is much smaller than that of the gas in the pipe in order to prevent the heat exchange between the gas in the pipes and the pipe wall to prevent heat flow from the hot side to the cold side. These pipes shown in FIG. 5 are cylindrical, but the shape thereof is arbitrary so long as the pipes substantially reduce diameter of flow path. Thus, stack of plates having many holes, porous materials and lumps of fiber may be used. The structure of the pressure transmitting pipe 5 for reducing the effective diameter of the flow path also improves the uniformity of temperatures over the pipe and reduces entropy generation due to heat diffusion.

Figure 6:
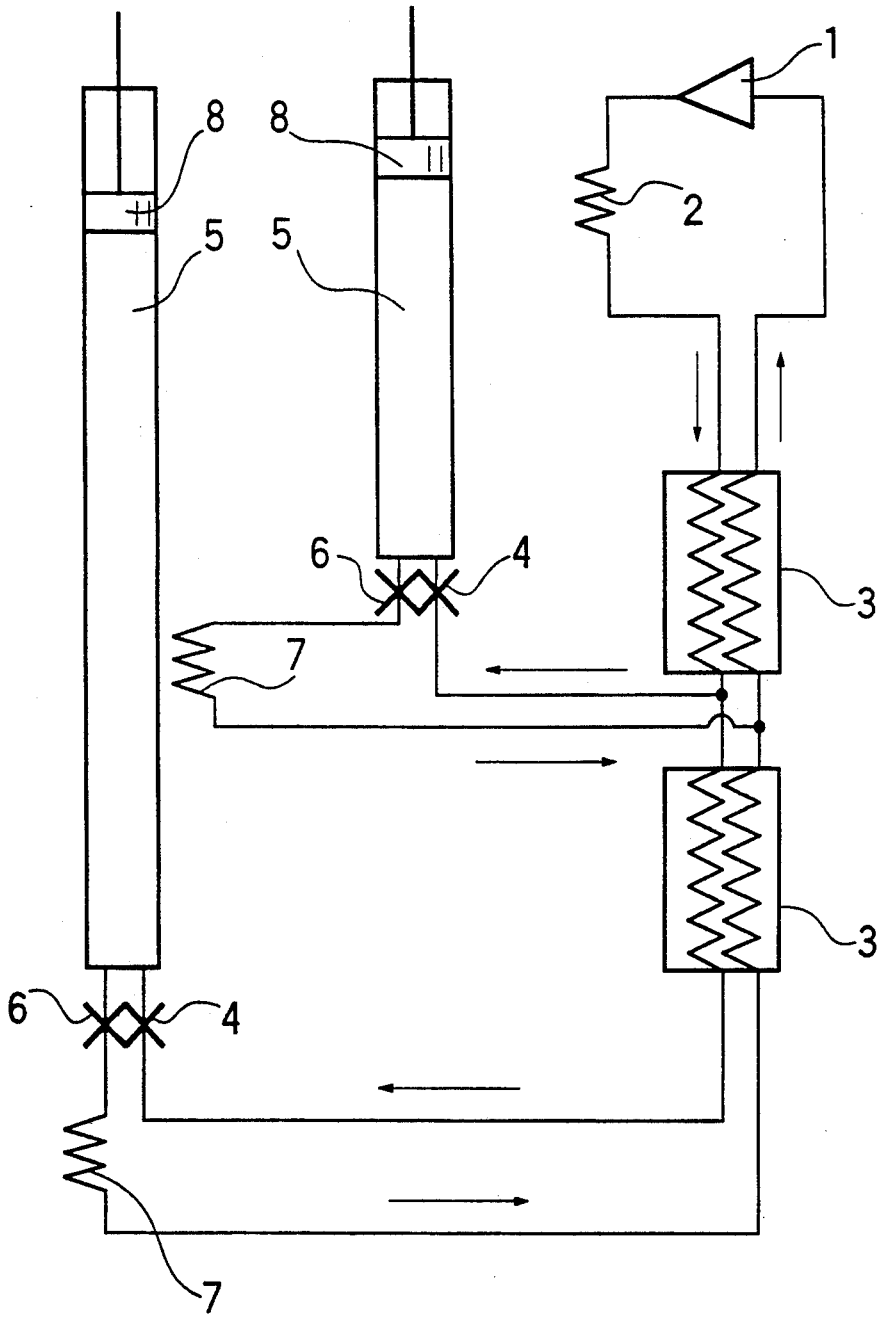
FIG. 6 is a schematic diagram showing an example of multi-stage refrigerator.
Figure 7A:
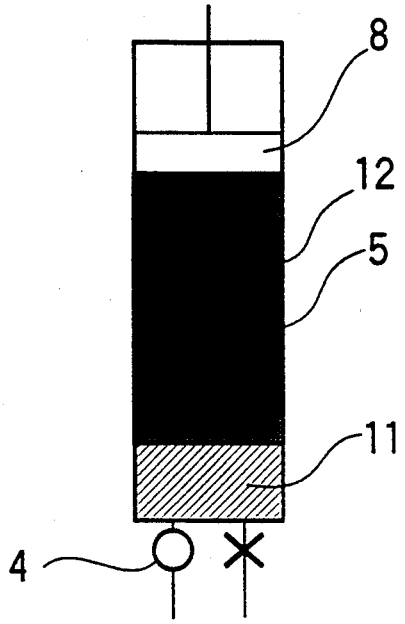
FIG. 7 is a schematic diagram showing an example based on another working cycle.
Figure 7B:
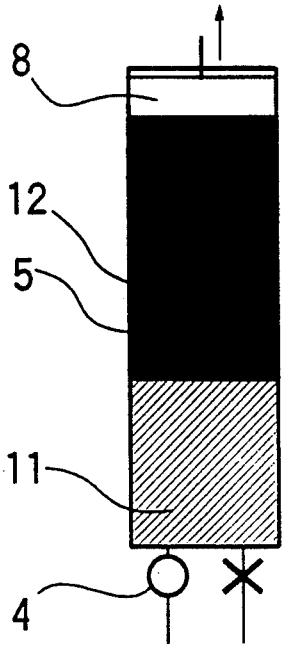
Figure 7C:
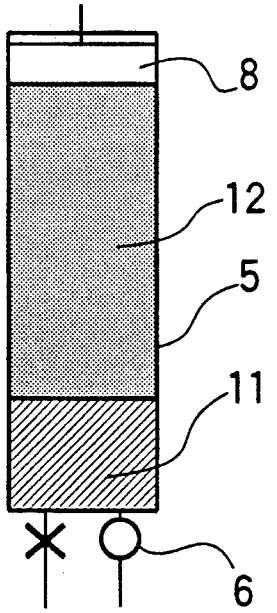
Figure 7D:
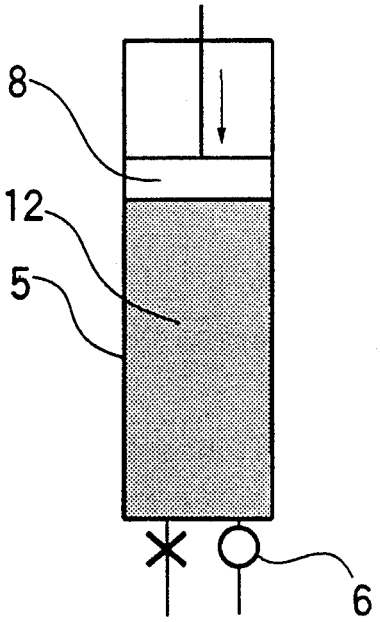

The example shown in FIG. 1 is a single stage refrigerator. It is effective to construct two or more stage type refrigerator as shown in FIG. 6. Especially, since in the high temperature portion the heat capacity of the pipe wall is large, it is difficult to keep the gas in the pressure transmitting pipe 5 adiabatic and the heat flow from the room temperature end to the low temperature end easily causes. If a multi-stage refrigerator is adopted, it is possible to absorb the heat flow in the middle of the flow pass. It is clear that cooling in an intermidiate temperature can be used to cool the heat shield and etc..

In the refrigerator according to this invention, it is possible to adopted another cycle other than the working cycle shown in FIG. 3 by changing the rising and descending timings of the piston and the opening and closing timings of the intake valve 4 and the exhaust valve 6. The other cycle is shown in FIG. 7. The cycle proceeds in the following order: (a) compression (the piston is stationary, the intake valve is open and the exhaust valve is closed), (b) intake (the piston is rising, the intake valve is open and the exhaust valve is closed), (c) expansion (the piston is stationary, the intake valve is closed, and the exhaust valve is open) and (d) exhaust (the piston is descending the intake valve is closed and the exhaust valve is open) and then completes one cycle.

Advantages of the cycle shown in FIG. 7 reside in that oscillation of temperatures in the period of one cycle is small because gas in the high temperature portion moves toward the low temperature end and it is expanded to decrease its temperature, in turn, gas in the low temperature portion moves toward the room temperature end and it is compressed to increase its temperature. Disadvantages reside in that the pressures before and behind the valves are not equal when the intake valve 4 and the exhaust valve 6 are opened and the amount of the working fluid passing through the heat exchanger 3 is large.

On the other hand, advantages of the cycle shown in FIG. 3 reside in that the pressures before and behind the valve are not equal when the intake valve 4 and the exhaust valve 6 are opened and the amount of the working fluid passing through the heat exchanger 3 is small. One of disadvantages reside in that the stroke of the piston 8 is long and another of disadvantages resides in that oscillation of temperatures in the period of one cycle is so large that it is difficult to make heat insulation against the environment because gas in the high temperature portion in the pressure transmitting pile 5 moves toward the low temperature end and it is compressed to increase its temperature, in turn, the gas in the low temperature portion moves toward the room temperature end and it is expanded to decrease its temperature. These two working cycles are selectively used considering the above advantages and disadvantages.

The working cycle shown in FIG. 7 is similar to that of the orifice pulse tube refrigerator. In the orifice pulse tube refrigerator, work is transferred in the pulse tube from the low temperature end to the room temperature end and the work is turned into heat when gas passes through the orifice, then the heat is removed by cooling water etc.. In this refrigerator, the transferred work is directly received in the form of work by the piston 8 provided in the room temperature portion. In the field of the pulse tube refrigerator, a moving plug pulse tube refrigerator has been examined. Therefore, the characteristic of this refrigerator resides in that it is possible by use of heat capacity of helium gas as the working fluid to improve the performance degradation of the regenerator due to lack of heat capacity of the cold heat accumulation materials at low temperatures.

When the refrigerator according to this invention is compared with the conventional refrigerators, sliding seal at a low temperature is dispensable because the piston is not in the low temperature portion, and further minimizing of the refrigerator becomes possible since the piston is not needed to be elongated.

When this invention is compared with the prior art pulse tube refrigerator, performance degradation of the regenerator which causes while the heat capacity of the regenerator matrix is smaller than that of the working fluid is not raised since this invention uses the heat exchanger and utilizes the heat capacity of the working fluid.

What is claimed is:

1. A refrigerator having a room temperature portion which is not within a refrigerated environment and a low temperature portion which is within a cooled environment, the refrigerator comprising:

a compressor disposed in the room temperature portion;

an expander including a pipe and a piston disposed in said pipe, said expander at least partially disposed in said room temperature portion, and wherein said piston is provided in a portion of the expander which is disposed in the room temperature portion; and wherein said expander further includes a column of gas disposed within said expander with at least part of the column of gas disposed in the room temperature portion such that pressure between the low temperature portion and the piston is transmitted through the column of gas.

2. In the refrigerator claimed in claim 1, the piston of the expander is separated by a flexible partition such as a bellows from gas which goes and returns between the low temperature portion and the room temperature portion.

3. In the refrigerator claimed in claim 1, means for reducing the effective diameter of flow path is further provided in the pipe for connecting the room temperature portion and the low temperature portion, whereby the Reynolds number is reduced to prevent tubulent flow.

4. The refrigerator of claim 1, wherein said expander is partially disposed in the room temperature portion and partially disposed in the low temperature portion, and wherein said column of gas is partially disposed in the room temperature portion and partially disposed in the low temperature portion.

* * * * *